US006746379B1

(12) United States Patent
Brawner

(10) Patent No.: US 6,746,379 B1
(45) Date of Patent: Jun. 8, 2004

(54) SELF-SPOTTING SAFETY BENCH PRESS

(76) Inventor: William Matthews Brawner, 2207 Hyde Dr., Apt. D, Greenville, NC (US) 27858

( * ) Notice: Subject to any disclaimer, the term of this patent is extended or adjusted under 35 U.S.C. 154(b) by 86 days.

(21) Appl. No.: 10/123,932

(22) Filed: Apr. 16, 2002

(51) Int. Cl.[7] ..... A63B 21/078; A63B 21/008
(52) U.S. Cl. ..... 482/104; 482/112
(58) Field of Search ..... 482/142, 93, 104, 482/111–113, 106

(56) References Cited

U.S. PATENT DOCUMENTS

| | | | | |
|---|---|---|---|---|
| 4,249,726 | A | | 2/1981 | Faust |
| 4,650,186 | A | | 3/1987 | McCreery et al. |
| 4,799,672 | A | | 1/1989 | Barrett |
| 4,807,875 | A | | 2/1989 | Tanski |
| 4,815,746 | A | | 3/1989 | Ward, Jr. |
| 4,875,676 | A | | 10/1989 | Zimmer |
| 4,949,959 | A | | 8/1990 | Stevens |
| 5,141,480 | A | * | 8/1992 | Lennox et al. |
| 5,273,506 | A | | 12/1993 | Dawson, Jr. |
| 5,281,193 | A | | 1/1994 | Colbo, Jr. |
| 5,310,394 | A | | 5/1994 | Kallioss |
| 5,314,394 | A | | 5/1994 | Ronan |
| 5,350,346 | A | * | 9/1994 | Martinez |
| 5,989,164 | A | | 11/1999 | Kullman et al. |
| 6,086,520 | A | | 7/2000 | Rodriquez |
| 6,293,892 | B1 | | 9/2001 | Slawinski et al. |
| 6,558,299 | B1 | * | 5/2003 | Slattery ..... 482/93 |

* cited by examiner

*Primary Examiner*—Jerome W. Donnelly
*Assistant Examiner*—Fenn Mathew
(74) *Attorney, Agent, or Firm*—MacCord Mason PLLC

(57) ABSTRACT

This invention is a Self Spotting Safety Bench Press composed of an adjustable bench and uprights located on either side of the bench adjacent the lifters upper body. Lifting arms extend from the uprights into the barbells pathway and have the ability to slide up and down to contact the barbell and decrease the weight exerted on the exerciser. Hydraulic cylinders provide force to each lifting arm, which is depressed below the barbells path before use. When assistance is needed, the exerciser releases a hydraulic restrictor valve causing the arms to ascend removing a user-determined amount of weight from the barbell while permitting the user to continue performing repetitions. A second restrictor valve can allow only upward movement should the exerciser fail. A third flow restrictor valve adjusts the rate of arm travel. An air charged hydraulic accumulator provides the hydraulic pressure to the cylinders.

20 Claims, 9 Drawing Sheets

SELF-SPOTTING SAFETY BENCH PRESS

BACKGROUND OF THE INVENTION (1) Field of the Invention

This invention relates to free weight exercise equipment, and specifically to an improved self-spotting bench press.

(2) Description of the Prior Art

The use of barbells, i.e., free weights, for conditioning and enhancement of the body's musculature is widely practiced by a variety of people. Often, these people prefer to weight lift in the privacy of their home, and when they feel like weight lifting.

Most common weight training is executed with a spotter, i.e., someone who can assist the lifter when they become fatigued or are having difficulty or are about to drop the weight. Style, communication, consistency and reaction time are all factors that vary when being spotted. These factors are major deterrents to using a human spotter. However, to weight lift without a spotter may be dangerous to the weight lifter. Without a spotter to grab the barbell and prevent the barbell from dropping on the weight lifter, there is a significant danger of serious injury due to fatigue or improper technique. This danger exists in situations from private to professional weight lifting.

The danger of crushing ones chest performing the bench press exercise is a great concern. U.S. Pat. No. 5,989,164 to Kullman et al (1999) shows a device that lifts the weight from the lifter's chest. While this device removes the weight from the lifter's chest, it utilizes cables that increase setup time and can cause increased or decreased resistance due to contact with the barbell. U.S. Pat. No. 6,086,520 to Rodriquez (2000) shows a device that also lifts the weight from the lifter's chest using a spring/motor combination. This device lacks the ability to adjust the amount of assist, and rate of lift to each lifter's preference. U.S. Pat. No. 5,310,394 to Killios (1994) describes a spotting machine that requires power to operate an electric motor that limits the machine to an area supplied with a power source.

All the machines heretofore known suffer from one or more of the following disadvantages:

a. Not being adjustable to suit each individual lifter's spotting preference, such as whether the spotting mechanism should assist the lifter by removing a fraction of the weight, remove all the weight, or not be used at all, and rate at which the spotting mechanism lifts the weight.

b. Not enabling the lifter to continue repetitions while being assisted by the spotting device and still having the ability to lock the spotting device preventing the weight from falling on or crushing the lifter.

c. Requiring electrical power.

d. Using barbell attachments such as cables that impede motion.

e. Using a greater quantity of material and being significantly larger and therefore heavier than traditional bench presses. This is more costly and discourages their use in private homes.

f. Not enabling the lifter to use the device with a human spotter.

SUMMARY OF THE INVENTION

The present invention relates to a safety device for supporting a barbell above a weightlifting bench, and to an apparatus comprised of the safety device in combination with a weightlifting bench.

Generally, the apparatus is comprised of first and second spaced, elongated uprights positionable on opposite sides of the head or upper end of a weightlifting bench head end. Each of the uprights includes a slotted, elongated outer housing, a rod longitudinally aligned within the housing, and a sleeve slidable on the rod between raised and lowered positions. A horizontal barbell support arm is attachable to inner end at various positions along the sleeve and extending outwardly from the housing through a first slot in the direction of the bench. The support arms are parallel and lie in a horizontal plane above the bench, with the arm intersecting the path of the barbell when it is being lifted.

First and second hydraulic cylinders are positioned alongside the first and second uprights respectfully. Each hydraulic cylinder is of a conventional design and is comprised of a tubular section with a hydraulic fluid inlet adjacent its lower end. A rod projects outwardly from the upper end of the cylinder. The inner end of the rod is connected to a piston within the cylinder. When hydraulic fluid enters the interior of the tubular section, the rod telescopes outwardly from the tubular section. The distal end of each cylinder is connected to an upright sleeve and the tubular section is affixed to the upright housing. Thus, as the rod is extended under the pressure of hydraulic fluid, the sleeve and attached support arm is caused to move upwardly.

Hydraulic fluid is stored within an accumulator of conventional design. Basically, the accumulator is comprised of a cylindrical housing with an air inlet at one end and a hydraulic outlet at the opposite end. A floating piston within the housing divides the cylinder into an air compartment and a hydraulic fluid compartment. Valves at each end of the accumulator control the flow of air and hydraulic fluid into and out of the accumulator. Hydraulic fluid is stored under pressure within the accumulator due to the compressed air on the opposite side of the piston. When the hydraulic fluid valve is opened, fluid flows from the accumulator to the hydraulic cylinders.

The apparatus may further include a user support bench, which is preferably of sufficient length to support the user's head and torso. When combined with the safety device, the head of the bench is mounted between the uprights. Preferably, the head of the bench can be raised and lowered. For example, a vertically adjustable bench support bar may extend between the uprights, with the head of the bench being supported on the bench support bar. An additional horizontal mounting bar may be used to attach the uprights to each other. The uprights may also include barbell rests attachable at various locations along the upright housings.

In order to control the position of the support arms, the apparatus includes a controller accessible by the user when reclined on the bench. This controller, which may be foot-operated, used to open the hydraulic valve, thereby causing pressurized hydraulic fluid to enter the hydraulic cylinders. As a result, the rods of the hydraulic cylinders are extended, raising the support arms and lifting the barbell away from the user. The valve may be partially opened to release a limited volume of fluid to only partially support the barbell, or fully opened to overcome all of the barbell weight, lifting the barbell from the user without the user's assistance.

OBJECTS AND ADVANTAGES

Accordingly, several object and advantages of my invention are:

a. to provide a new and novel safety device or apparatus for an individual engaged in the activity of weight lifting.

b. To provide a new and novel device that acts instead of a spotter (eliminates need for spotter).

c. To provide a device that enables the lifter to easily adjust the rate at which the device assists (raises the weight from) the lifter.

d. To provide a device that enables the lifter to easily adjust the amount of assistance provided by the machine.

e. To provide a device easily set up that can either assist in lifting the weight or lift the weight in its entirety.

f. To provide a device that when actuated, enables the lifter to continue performing repetitions while being assisted.

g. To provide a device that when actuated by the lifter, does not allow any downward movement of the weight.

h. To provide a device that does not require electrical power.

i. To provide a device that can be used with a traditional human spotter.

j. To provide a device with a shape, weight and size similar to traditional manual machines.

k. To provide a device that is adjustable to the lifters body size (arm length).

l. To provide a device that enables the user to exercise with the seat in incline, flat, and decline positions.

Further objects and advantages of my invention will become apparent from a consideration of the drawings and ensuing description.

| Brief Description of The Drawings | |
|---|---|
| FIG. 1 | Self Spotting Safety Bench press Composite |
| FIG. 2 | Inner and Front Side of Upright |
| FIG. 3 | Outer Side of Upright |
| FIG. 4 | Upright Internal and External Attachments |
| FIG. 5 | Lifting Arm |
| FIG. 6 | Adjustable Seat and Weight Rest |
| FIG. 7 | Adjustable Seat and Weight Rest |
| FIG. 8 | Hydraulic & Pneumatic System |
| FIG. 9 | Free Weight Resting Position |

| List of Reference Numerals | |
|---|---|
| 1 | Upright |
| 2 | Upright support |
| 3 | Cross bar |
| 4 | Seat |
| 5 | Seat support bar |
| 6 | Slide bar |
| 7 | Slide |
| 8 | Lifting arm |
| 9 | Hydraulic cylinder slide attachment |
| 10 | Hydraulic cylinder upright attachment |
| 11 | Hydraulic cylinder |
| 12 | Adjustable weight rest and seat bar support |
| 13 | Actuator |
| 14 | Slide bearing |
| 15 | Accumulator |
| 16 | Accumulator pump |
| 17 | Accumulator air supply line |
| 18 | Hydraulic cylinder fluid supply line. |
| 19 | Adjustable hydraulic fluid flow valve |
| 20 | One way hydraulic flow valve (to cylinder) |
| 21 | One way flow valve (to accumulator) |
| 22 | Actuator cables |
| 23 | Weight rest support holes |
| 24 | Lifting arm slot |
| 25 | Hydraulic cylinder slide attachment slot |
| 26 | Lift arm support holes |
| 27 | Lift arm semi circles |
| 28 | Support pins |
| 29 | Cap |
| 30 | Centering plate |

-continued

Figure 1:
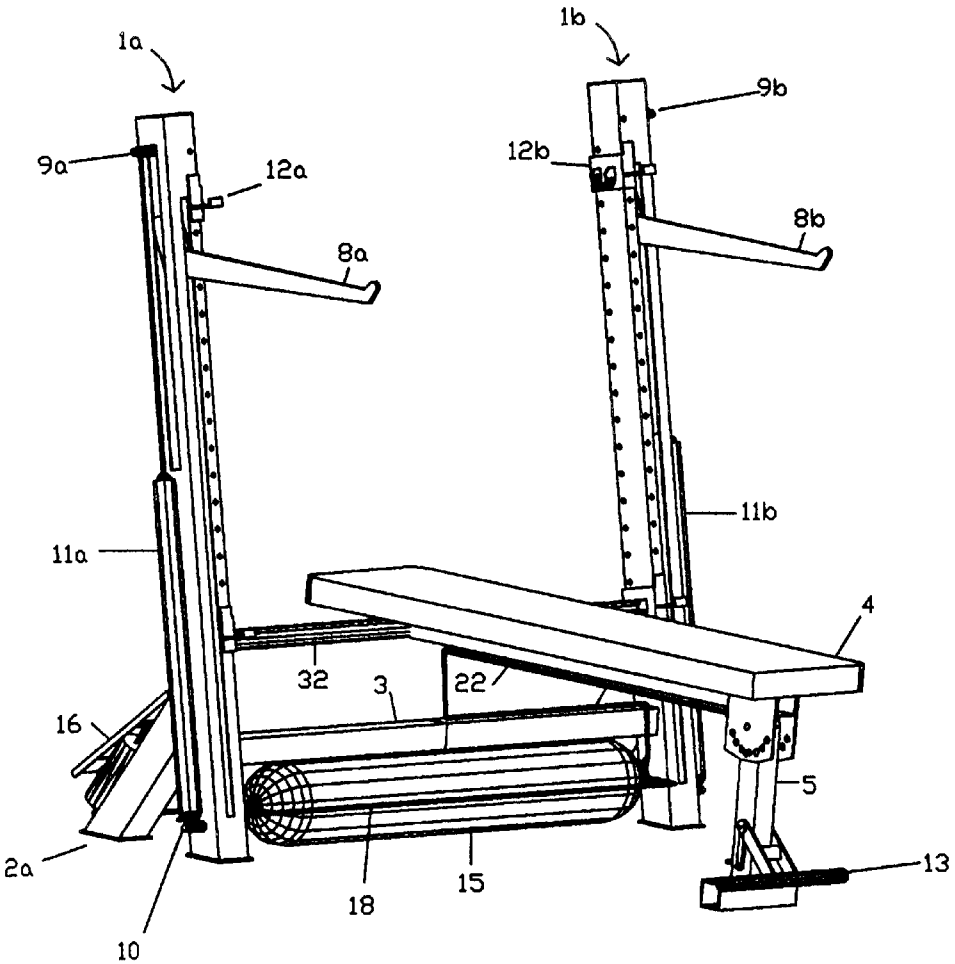

| List of Reference Numerals | |
|---|---|
| 31 | Floor plate |
| 32 | Seat support bar |
| 33 | Barbell |

When reference numerals identify multiples of similar parts those parts will be labeled with the coinciding number followed by a letter. For example there are two Uprights, 1*a* and 1*b*.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

FIG. 1 shows a composite drawing of the device. There are 2 uprights (1*a*, 1*b*) parallel to each other and tilted slightly away from the longer side of the seat (4). Two adjustable weight rests and seat supports (12*a*, 12*b*) are located on the inner side of each upright. Protruding from the front of each upright (1*a*,1*b*) is a lifting arm (8*a*,8*b*) that extends perpendicular to gravity, and in the direction of the seat (4). Each upright (1*a*,1*b*) has a support (2*a* shown only) and is connected to the other via a cross bar (3). Mounted on the cross bar is an Accumulator (15). The accumulator is attached to a pump (16) via an air supply line (17). The other end of the accumulator is connected to hydraulic cylinders (11*a*, 11*b*) via a fluid supply line (18). The hydraulic cylinders (11*a*,11*b*) are mounted at one end to the bottom of an upright (1*a*,1*b*) on the hydraulic cylinder upright attachment (10), and the other end to the hydraulic cylinder slide attachment (9*a*,9*b*) that protrudes from the outer side of each upright (1*a*,1*b*). Above the center of the cross bar (3) is an adjustable seat support bar (32) that supports one end of the seat (4). The other end of the seat is supported by an adjustable vertical seat support (5). Attached to the vertical seat support, close to the floor is an actuator. Actuator cables (22) extend from the actuator to hydraulic fluid valves (see FIG. 8).

Figure 2:
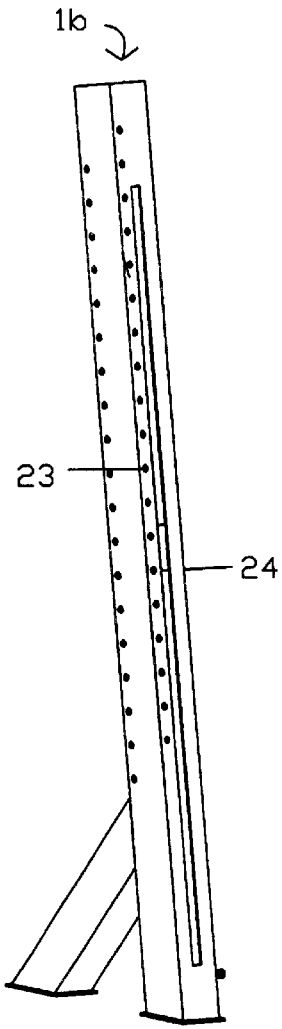

FIG. 2 focuses on upright (1*b*). The inner side and front side of upright (1*b*) contains weight rest support holes (23) extending partially down the upright. The front of the upright (1*b*) to the right of the holes contains a lifting arm slot (24).

Figure 3:
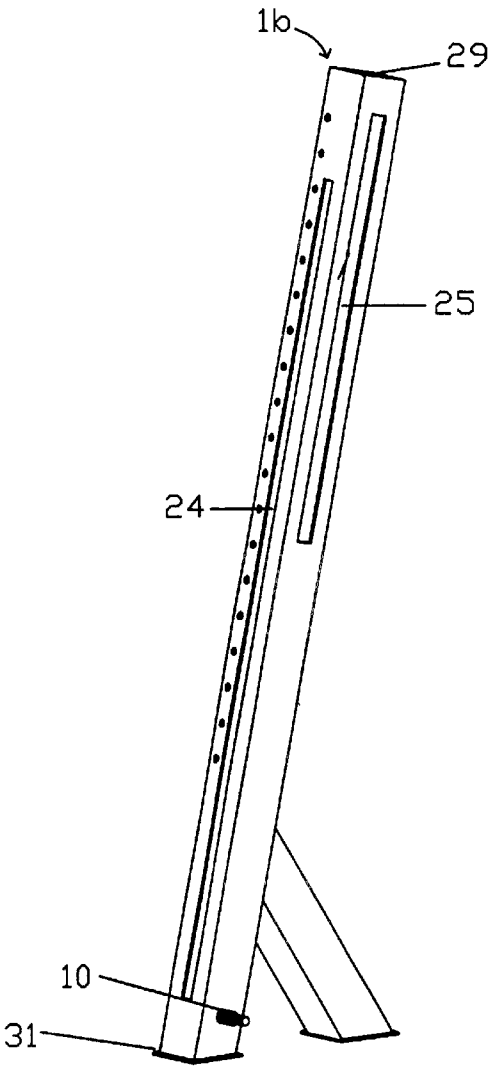

FIG. 3 shows the outer side of the upright (1*b*) containing a hydraulic cylinder slide attachment slot (24) and a hydraulic cylinder upright attachment (10). Contained within the upright are centering holes for holding the slide bar (6*b*) that can be seen in FIG. 4.

Figure 4:
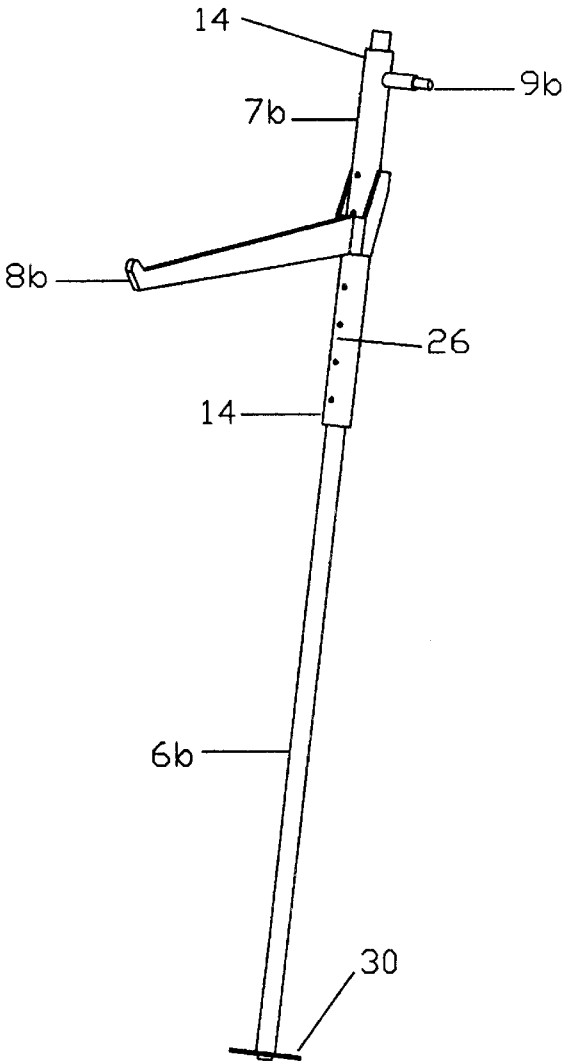

FIG. 4 shows the parts an upright (1*b*) contains without the upright itself included. The slide bar (6*b*) nearly extends the full length of the upright (1*b*). Mounted on the slide bar (6*b*) is the slide (7*b*) which has been fastened with the hydraulic cylinder slide attachment (9*b*). In addition, the slide has lift arm support holes (26) and slide bearings (14) at either end. The lifting arm (8*b*) is able to be mounted on the slide (7*b*) in various positions.

Figure 5:
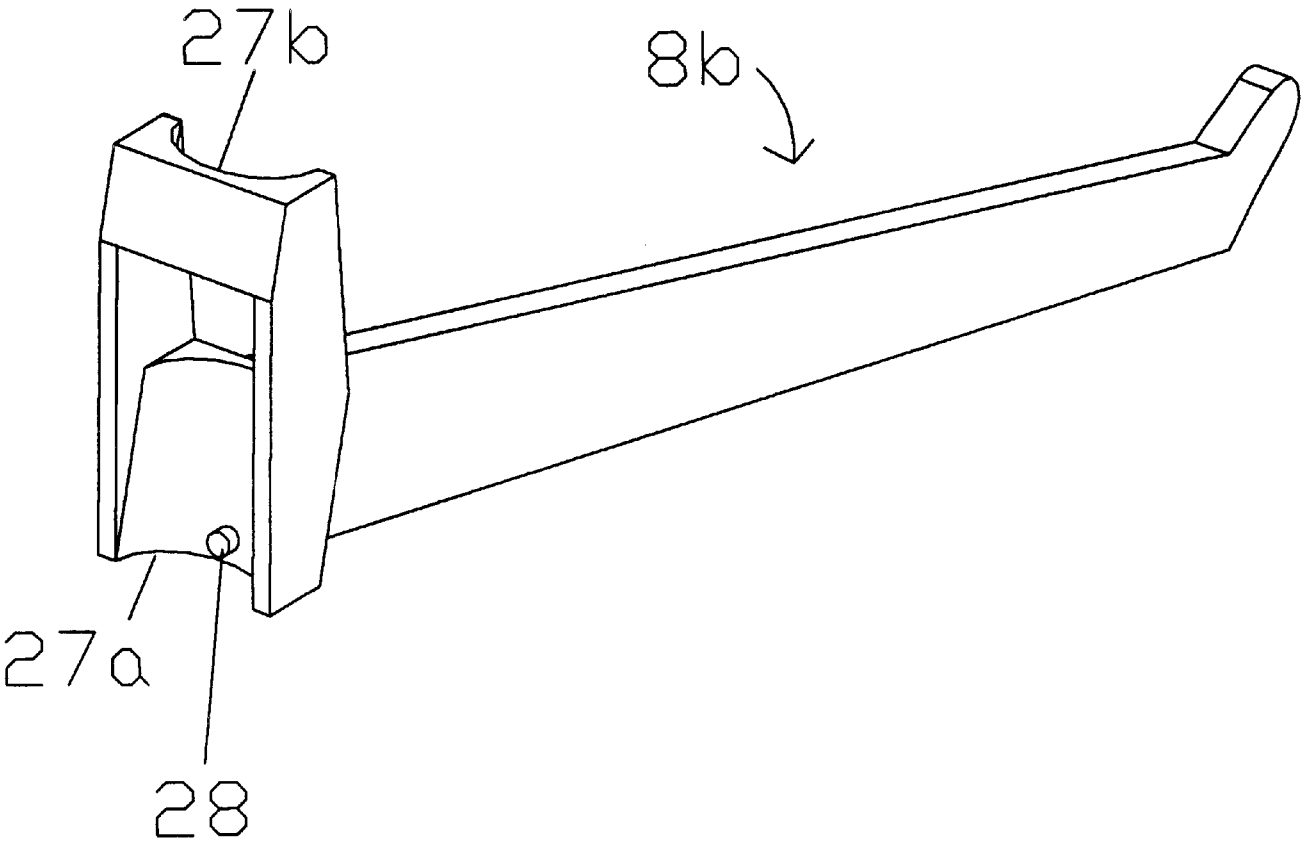

FIG. 5 shows lifting arm (8). The slide contact of the lifting arm (8) contains two semi circles (27*a*, 27*b*). The first is directly behind the arm extension (27*a*) to contact the front of the slide. This semicircle contains a pin at its center that coincides with the lift arm support holes (26). The second semi circle (27*b*) contacts the back of the slide. This contact point is higher on the slide (7*b*) (FIG. 4) than the first semicircle. This semicircle arrangement causes the lift arm pin (28) to slide out of the lift arm support hole (26) (FIG. 4) when the tip of the arm is raised (the pivot pint roughly being between the upper and lower semicircles). This action also causes the semi circles to no longer tightly contact the slide (7*b*), permitting movement of the lifting arm up and down the slide (7*b*) enabling adjustment.

Figure 6:
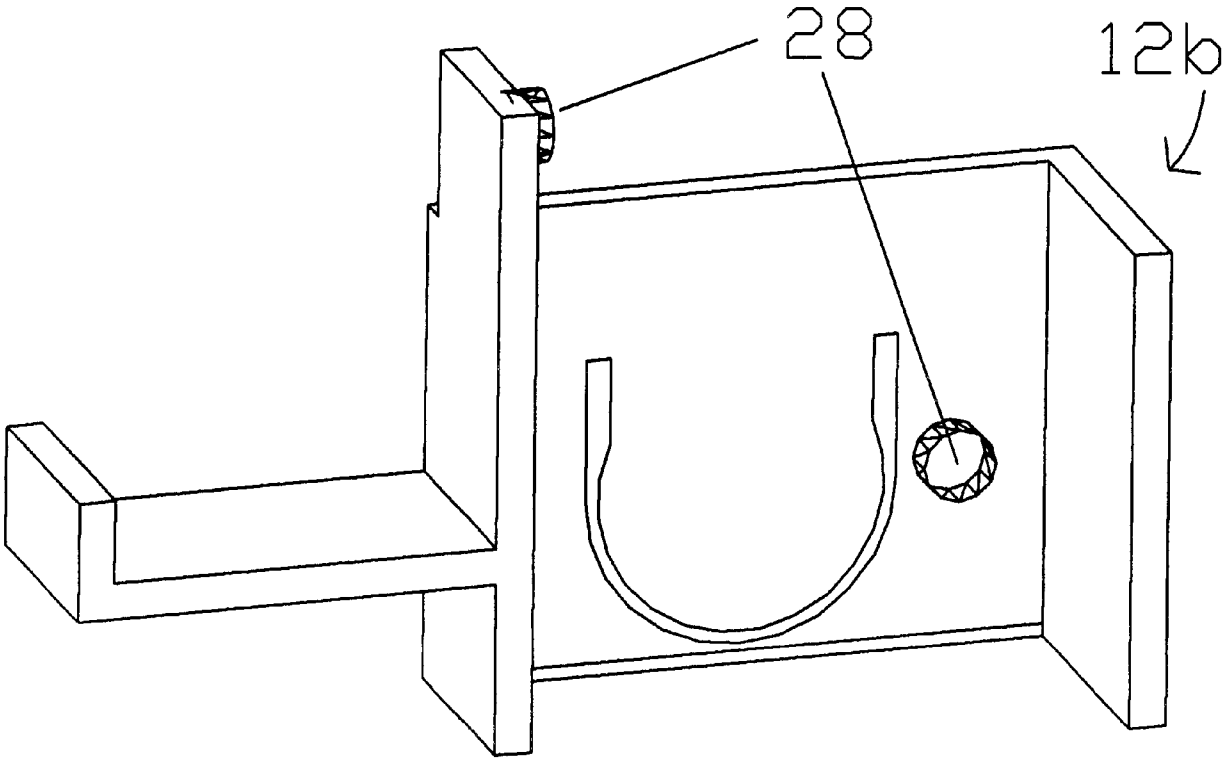
Figure 7:
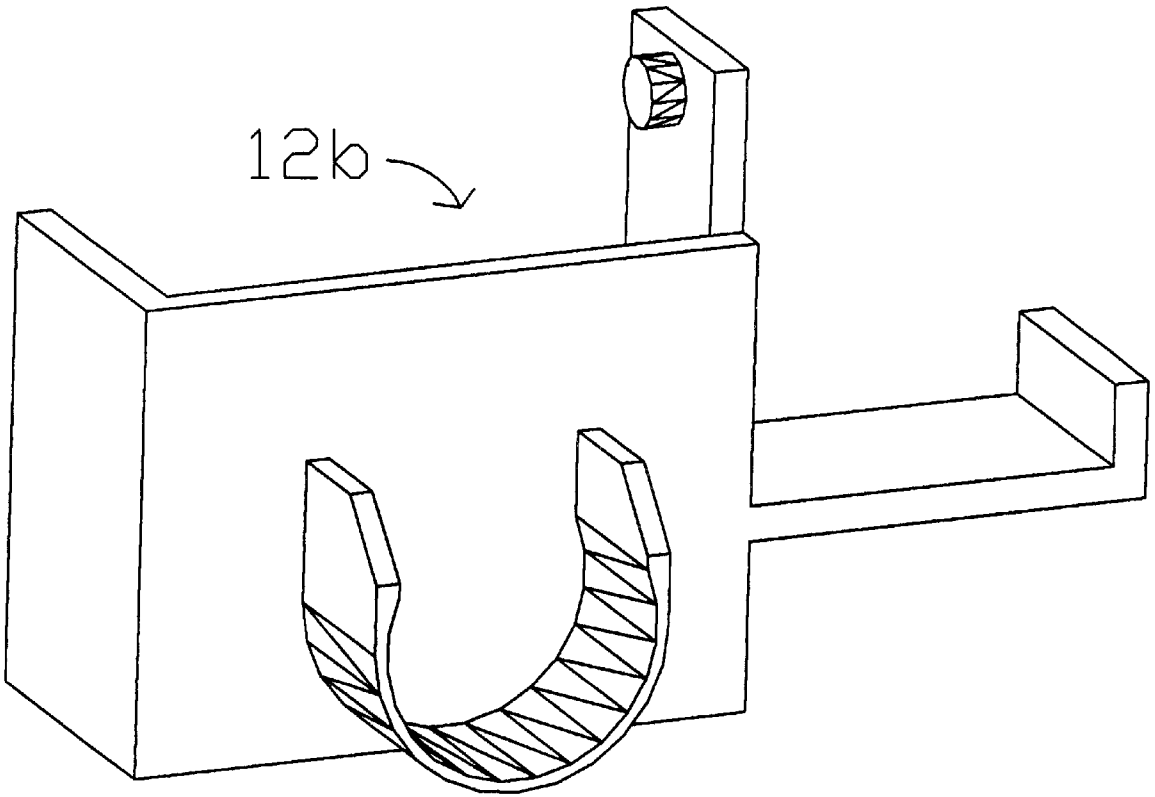

FIGS. 6 and 7 show the adjustable seat and weight rest (12*b*). This piece is "u" shaped to partially wrap around an upright (1*b*). It contains two mounting pins. The first pin is located on the backside of the front plate containing the barbell support extension. The second pin is located on the side plate to extend into the inner weight rest support holes (23). Pin location coincides with the weight rest support holes (23). Pin location allows the front pin to slide into the rest support hole (23) when the adjustable seat and weight rest (12*b*) is rotated clockwise 90 degrees. With the first pin seated in the support hole, rotation of the adjustable weight rest (12*b*) 90 degrees counter clock wise (with the front pin within the support hole (23) being the axis of rotation) seats the inner pin in the inner rest support hole (23). This part also has a semicircle attachment mounted on its inner most face. This semicircle is of suitable size and shape to support the seat support bar (32) when attached to an upright.

Figure 8:
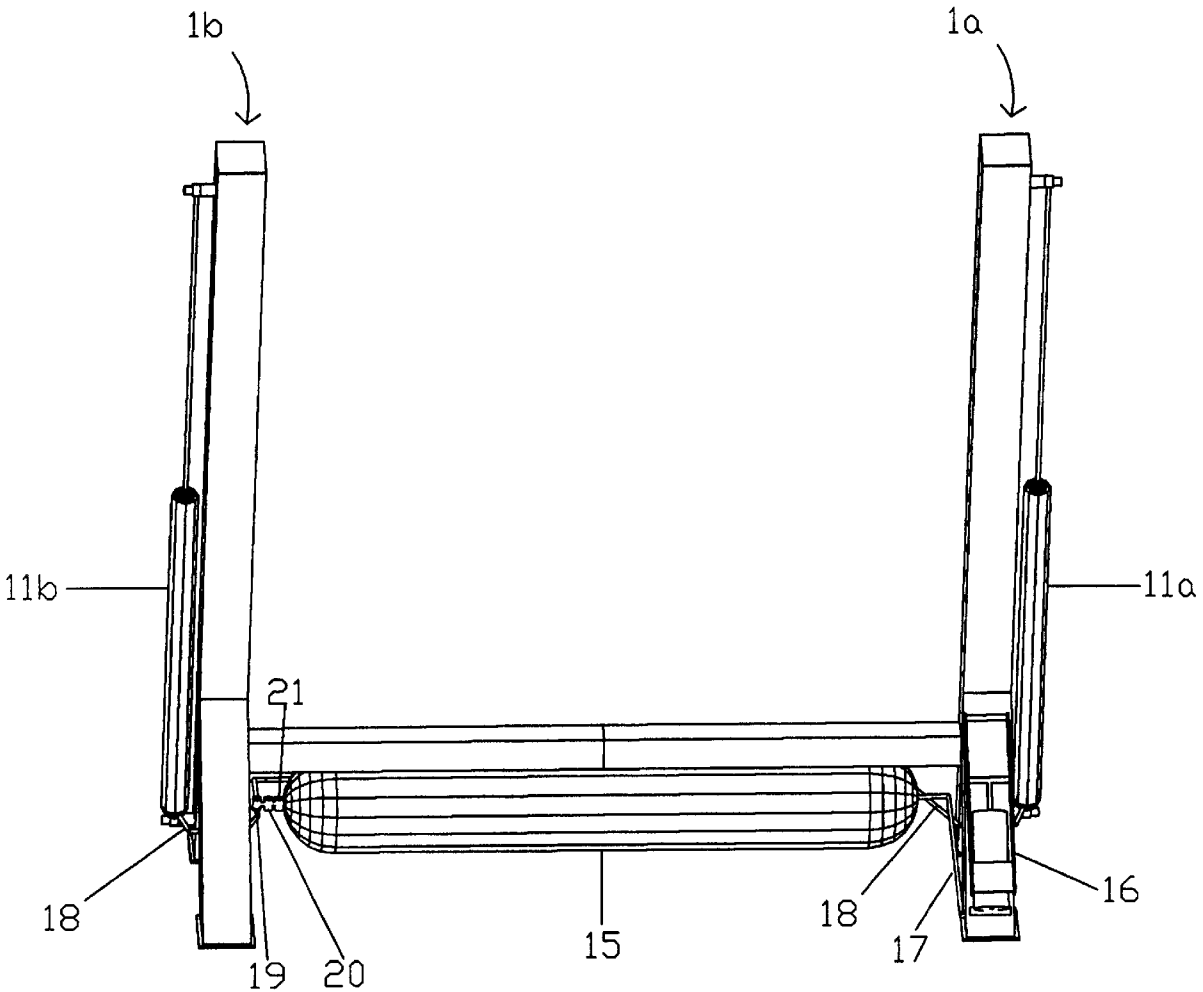

FIG. 8 shows the Hydraulic and Pneumatic system that powers the self-spotting bench. The accumulator (15) is connected at one end to an air pump (16) via an air line (17). A hydraulic line (18) exits the accumulator (15) from the other end and leads to three valves; one way valve to cylinder (20),one way valve to accumulator (21), and the flow rate valve (19). The hydraulic line then splits and leads to each hydraulic cylinder (11*a*, 11*b*).

OPERATION

Figure 9:
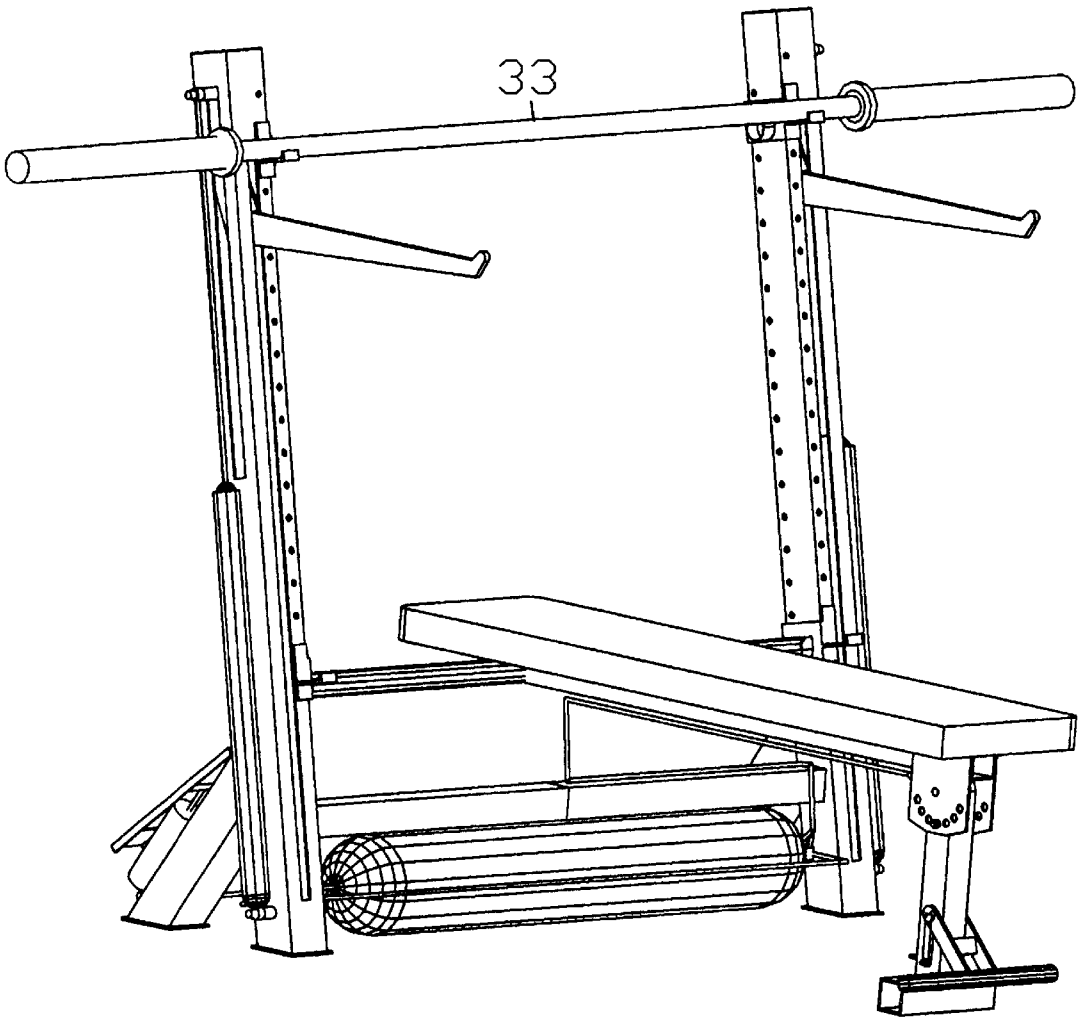

FIG. 9 shows the barbell (33) free weight starting point held on the adjustable weight rest and seat bar support (12). The distance from the seat (4) (and therefore the lifter) can be adjusted by rotating each adjustable weight rest 90 degrees away from the upright (1*a*, 1*b*) using the front pin as a pivot point. After being rotated the adjustable weight rest and seat bar support (12) can be separated from the upright (1) by moving it perpendicular to the upright in the direction the lifting arm (8) extends. The adjustable weight rest and seat bar support (12) can be reattached in other locations performing the reverse of these instructions in any other weight rest support hole (23).

The lifting arm range location can be adjusted upward and downward to the lifters preference. This is done by tilting the tip of the lifting arm (8*a*,8*b*) upward causing the semicircles (27) to separate from the slide (7) and the support pin (28) to slide out of the lift arm support hole(26). In this position the lifting arm can be slid up and down the slide (7) then relocated in another position.

With the barbell held on the adjustable weight rest (12*a*, 12*b*) the lifter can now set the one-way flow valve (to accumulator) (21) to be active. This will allow the lifting arms (8*a*, 8*b*) to only move downward. The lifter has two options as to how to depress the lifting arms (8*a*, 8*b*). The first option is to get in the exercising position, remove the barbell (33) from the adjustable weight rests allowing the weight to lower and depress the lifting arms (8*a*, 8*b*), and then start repetitions from the lowest point the bar traveled. The second option is to depress each lifting arm (8*a*, 8*b*) by hand to a point where it will not interfere with the exercise until released.

If the lifter desires an increased or decreased assisting force exerted on the barbell by the lifting arms, an air adjustment can be made to the accumulator by either pumping (16) more air in or releasing air. If the rate at which the lifting arm ascends is too slow or fast the adjustable hydraulic fluid flow valve (19) can also be manipulated to suit user preference.

With the lifting arms depressed and equipment adjusted to suit lifter preferences the repetitions are started. When the lifter needs a "spot" the one way flow valve (to accumulator) is released. The compressed air in the accumulator (15) acts as a spring and forces hydraulic fluid through the hydraulic cylinder fluid supply line (17) and into the hydraulic cylinder (11*a*, 11*b*). The cylinder shaft then raises the slide (7) causing the attached lifting arm to also rise. The lifting arms contact the barbell and assist (spot) the lifter. The opposite of this action occurs when the lifting arms are being depressed (i.e. the hydraulic fluid in the hydraulic cylinders (11*a*, 11*b*) is forced back into the accumulator where potential energy is stored in the form of compressed air.).

With the one-way flow valve (to accumulator) (21) released the lifting arms (8) will be permitted to move up and down while still asserting an assisting force on the barbell (33). This allows the lifter to continue by performing assisted repetitions when he/she could no longer lift the original weight unassisted. Should the upward force desired by the lifter exceed the weight of the barbell the entire weight will be lifted by the machine, not permitting assisted repetitions.

When the lifter is no longer able to perform the assisted repetitions (or whenever else the lifter desires) the one way flow valve (to cylinder) (20) can be engaged. This will only allow hydraulic fluid to flow toward the cylinders (11*a*,11*b*) thus allowing the lifting arms to raise but not be lowered. This will allow the lifter to lift the barbell with assistance, and then prevent the barbell (33) from falling on the lifter when failure occurs.

The manipulation of the one way flow valves (21,22) mentioned above is accomplished by use of an actuator (13) the exerciser manipulates with his/her lower leg or foot. The Actuator (13) is connected to the hydraulic valves via actuator cables (22) and pulley transmission system. When the actuator (13) is kicked once in the direction of the accumulator (15) the one way valve to the accumulator (21) will be released. When kicked a second time the one way valve to the cylinder (20) will be engaged. The system can then be reset by either kicking the actuator (13) a third time or manually resetting the one way flow valves (21,22).

Due to the stress the exerciser is experiencing during failure the exercisers leg or foot is likely to contact the actuator with significant force. The actuator therefore has a limited range of motion and does not transfer all of this energy to the valves. For the same reason the actuator is constructed with suitable smooth surface area as to not injure the exerciser when kicked. The design of the actuator (13) shown in FIG. 1 is not intended to limit the scope of this invention. A lanyard that attaches to the exercisers leg or foot is also feasible.

Thus the reader will see that the self-spotting safety bench press of this invention provides a dependable spotting machine that increases user safety. The spotting speed and force exerted is fully adjustable to suit user preferences, as is the spotting arm range location, weight rest position, and seat position. This machine has two spotting modes. The first mode allows the lifter to continue repetitions (up and down) assisted by the machine. The second mode only allows upward movement, preventing the weight from falling on the lifter. Furthermore this machine requires no electrical power and is of a weight and size similar to traditional non-spotting bench presses. These attributes make this machine more likely to be used in homes and other private residences.

While my above description contains many specificities, these should not be construed as limitations on the scope of the invention, but rather as an exemplification of one preferred embodiment thereof. Many other variations are possible. For example, the uprights described above do not have to be tilted away from the seat extension of the bench. Still another example is that the spotting device used with this machine is not to be limited to use with only one type of seat. A seat adjustable to various incline, decline and flat positions and seats in fixed positions are all types that can be used with this device.

Accordingly, the scope of the invention should be determined not by the embodiments illustrated, but by the appended claims and their legal equivalents.

What is claimed is:

1. An apparatus for safely supporting a barbell above a weight lifting bench comprising:

a) first and second spaced, elongated uprights positionable on opposite sides of said bench, each of said uprights including a vertically adjustable barbell support having a raised position and a lowered position, and a hydraulic cylinder having a first end connected to said barbell support and a second end connected to said upright;

b) an accumulator for storing hydraulic fluid under pressure, said accumulator having a housing with a floating piston within the housing dividing the housing into an air compartment and a hydraulic fluid compartment connected by fluid lines to said hydraulic cylinders;

c) a foot-operated pump connected to said accumulator by an air line to pump air into said accumulator; and d) an actuator for controlling the flow of fluid from said accumulator to said hydraulic cylinders, whereby flow of fluid into said cylinders urges said supports toward their upright position.

2. The apparatus of claim 1, wherein each of said uprights includes a slotted outer housing, a rod longitudinally aligned within said housing, and a sleeve slidable on said rod, said barbell support being attached to said sleeve and extending outwardly from said upright through said slot, said cylinder first end being connected to said sleeve.

3. The apparatus of claim 1, wherein said uprights are tilted rearwardly.

4. The apparatus of claim 1, further including a horizontal attachment member joining said uprights.

5. The apparatus of claim 1, further including a horizontal bench support member extending between said uprights.

6. The apparatus of claim 1, wherein said actuator is positioned for access by a user's foot.

7. The apparatus of claim 1, wherein said uprights include barbell weight rests attached to said uprights at selected vertical positions.

8. An apparatus for safely supporting a barbell during weight lifting comprising:

a) a weight bench having a head end and a lower end;

b) first and second spaced, elongated uprights positioned on opposite sides of said bench head end, each of said uprights including a vertically adjustable barbell support having a raised position and a lowered position extending toward said bench lower end, and a hydraulic cylinder having a first end connected to said barbell support and a second end connected to said upright;

c) an accumulator for storing hydraulic fluid under pressure, said accumulator having a housing with a floating piston within the housing dividing the housing into an air compartment and a hydraulic fluid compartment connected by fluid lines to said hydraulic cylinders;

d) a foot-operated pump connected to said accumulator by an air line to pump air into said accumulator; and e) an actuator for controlling the flow of fluid from said accumulator to said hydraulic cylinders, whereby flow of fluid into said cylinders urges said supports toward their upright position, said actuator including a valve in said fluid line.

9. The apparatus of claim 8, wherein said bench is tiltable.

10. The apparatus of claim 8, wherein said actuator is positioned adjacent the lower end of said bench.

11. The apparatus of claim 8, further including a vertically adjustable bench support extending between said uprights, the head end of said bench being supported on said bench support.

12. The apparatus of claim 8, wherein each of said uprights includes a slotted outer housing, a rod longitudinally aligned within said housing, and a sleeve slidable on said rod, said barbell support being attached to said sleeve and extending outwardly from said upright through said slot, said cylinder first end being connected to said sleeve.

13. The apparatus of claim 8, wherein said uprights are tilted rearwardly.

14. The apparatus of claim 8, further including a horizontal attachment member joining said uprights.

15. An apparatus for safely supporting a barbell during weight lifting comprising:

a) a tiltable weight bench for supporting a users head and torso, said bench having a head end and a lower end;

b) first and second spaced, elongated uprights positioned on opposite sides of said bench head end, each of said uprights including a slotted outer housing, a rod longitudinally aligned within said housing, a sleeve slidable on said rod between a raised position and a lowered position, and a horizontal barbell support attached to said sleeve and extending outwardly from said housing through said slot;

c) first and second hydraulic cylinders, each cylinder having a first end connected to one of said barbell supports and a second end connected to said upright housing;

d) an accumulator for storing hydraulic fluid under pressure, said accumulator having a housing with a floating piston within the housing dividing the housing into an air compartment and a hydraulic fluid compartment connected by fluid lines to said hydraulic cylinders;

e) a foot-operated pump connected to said accumulator by an air line to pump air into said accumulator; and f) an actuator for controlling the flow of fluid from said accumulator to said hydraulic cylinders, whereby flow of fluid into said cylinders urges said supports toward their upright position, said actuator including a valve in said fluid line and a valve controller operable by said user when said user is positioned on said bench.

16. The apparatus of claim 15, wherein said bench is padded.

17. The apparatus of claim 15, wherein said uprights are tilted rearwardly.

18. The apparatus of claim 15, further including a horizontal attachment member joining said uprights.

19. The apparatus of claim 15, further including a vertically adjustable, horizontal bench support extending between said uprights, the head end of said bench being supported on said bench support.

20. The apparatus of claim 15, wherein said valve controller is positioned for access by a user's foot when the user is on said bench.

* * * * *